US007639977B2

(12) United States Patent
Furumizu et al.

(10) Patent No.: US 7,639,977 B2
(45) Date of Patent: Dec. 29, 2009

(54) IMAGE FORMING APPARATUS THAT PERFORMS CHARGE ELIMINATION AFTER SECONDARY TRANSFER TO PREVENT WINDING OF RECORDING MEDIUM ON INTERMEDIATE TRANSFER MEMBER

(75) Inventors: Mikio Furumizu, Matsumoto (JP); Masahiro Maeda, Matsumoto (JP); Yoichi Yamada, Shiojiri (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 399 days.

(21) Appl. No.: 11/561,269

(22) Filed: Nov. 17, 2006

(65) Prior Publication Data

US 2007/0147860 A1 Jun. 28, 2007

(30) Foreign Application Priority Data

Nov. 18, 2005 (JP) ..... P2005-333845
Nov. 18, 2005 (JP) ..... P2005-333846
Nov. 18, 2005 (JP) ..... P2005-333847

(51) Int. Cl.
*G03G 15/14* (2006.01)
*G03G 15/00* (2006.01)

(52) U.S. Cl. ..... 399/315; 399/44

(58) Field of Classification Search ..... 399/44, 399/66, 314, 315, 389, 398
See application file for complete search history.

(56) References Cited

U.S. PATENT DOCUMENTS 4,521,103 A * 6/1985 Ohtsuka et al. ..... 399/44
4,912,515 A * 3/1990 Amemiya et al. ..... 399/44
5,890,030 A * 3/1999 Namekata et al. ..... 399/66
6,337,968 B1 * 1/2002 Hayashida ..... 399/315
7,099,598 B2 * 8/2006 Dougherty et al. ..... 399/44 X
2004/0170453 A1 * 9/2004 Ito et al. ..... 399/315

* cited by examiner

*Primary Examiner*—Sandra L Brase
(74) *Attorney, Agent, or Firm*—Hogan & Hartson LLP

(57) ABSTRACT

An image forming apparatus is operable to form an image on a recording medium. An image carrier is adapted such that a toner image is formed thereon by developing an electrostatic latent image. An intermediate transfer member is adapted such that the toner image is primarily transferred thereto. In a transfer device, a roller member is adapted to come in contact with the intermediate transfer member. A first bias voltage applier is operable to provide a transfer voltage, thereby applying a first bias voltage between the roller member and the intermediate transfer member to secondarily transfer the toner image onto the recording medium in order to obtain the image. A charge eliminator is disposed in the vicinity of the roller member. A second bias voltage applier is operable to apply a second bias voltage to the charge eliminator to eliminate charges on the recording medium which has been subjected to the application of the first bias voltage. A controller is operable to vary the second bias voltage in accordance with a deviation amount of the first bias voltage.

8 Claims, 10 Drawing Sheets

IMAGE FORMING APPARATUS THAT PERFORMS CHARGE ELIMINATION AFTER SECONDARY TRANSFER TO PREVENT WINDING OF RECORDING MEDIUM ON INTERMEDIATE TRANSFER MEMBER

BACKGROUND

1. Technical Field

The present invention relates to an image forming apparatus such as a printer, a facsimile, or a copying machine for forming an image on a recording medium such as paper by using the electronic photography technique and; more particularly, to an image forming apparatus having a secondary transfer device for transferring a toner image by applying a transfer bias voltage from an intermediate transfer member to a recording medium under a constant current control.

2. Background Art

Japanese Patent Publication No. 11-288184, discloses an image forming apparatus for forming an image on a recording medium such as a paper sheet by using the electronic photography technique. This image forming apparatus has a secondary transfer device for applying a transfer bias voltage to a secondary transfer roller under a constant current control so that a toner image on an intermediate transfer member such as an intermediate transfer belt or an intermediate transfer drum may be secondarily transferred to the recording medium such as the paper sheet. In this apparatus, at the position opposing a drive roller (serving as a secondary transfer backup roller) for the intermediate transfer belt, there is disposed a secondary transfer roller which is retractably brought into contact with the intermediate transfer belt. At this position, the transfer bias voltage is applied to the secondary transfer roller by a constant current controller so that toner images of four colors on the intermediate transfer belt are secondarily transferred to the recording medium.

The recording medium having the transferred tone image is charged. If this charged state is left as it is, a drawback is encountered by the obstruction to the subsequent smooth transporting of the recording medium, a charge elimination has to be made on the recording medium. For this purpose, there is provided a charge eliminator, which is formed of non-woven fabric of conductive fibers into a sheet, in the vicinity of the downstream side of the secondary transfer roller. The charge eliminator is adhered to a conductive plate for applying a charge elimination voltage thereto, and eliminates the charge on the recording medium after the secondary transfer.

FIG. 2 shows an example of such a secondary transfer device. An intermediate transfer belt 21 is stretched between a drive roller 50 serving as a secondary transfer backup roller and a not-shown follower roller or tension roller, and is circulated in a prescribed direction by the drive roller 50. The secondary transfer roller 51 is retractably brought into contact with the intermediate transfer belt 21 by a not-shown actuating mechanism. When the secondary transfer roller 51 comes in contact with the intermediate transfer belt 21, it is pressed against the intermediate transfer belt 21 by a not-shown urging member such as springs mounted on the both ends of the secondary transfer roller 51. The secondary transfer roller 51 is rotated in cooperation with the circulation of the intermediate transfer belt 21, and a recording medium is transported into a nip portion formed between the secondary transfer roller 51 and the intermediate transfer belt 21 at a prescribed angle defined by a guide member 52 which is configured to be pivotable about a pivot shaft 53.

The guide member 52 is equipped with a charge eliminator 54 adjacent to the secondary transfer roller 51. The charge eliminator 54 is made of conductive non-woven fabric (or charge eliminating fabric), which is worked from numerous conductive fibers into a sheet shape. The upper face of the charge eliminator 54 made of the charge eliminating fabric is opposed to the recording medium having passed through the secondary transfer device so that a discharge is established between the charge eliminator 54 and the recording medium thereby to eliminate the charge on the recording medium. The charge eliminator 54 is adhered to a conductive plate 55. The charge eliminating voltage is applied from a not-shown power source through the plate 55.

As shown in FIG. 3, an attracting force (represented by an arrow A) by the plate 55 and a winding force (represented by an arrow B) by the winding electric field to occur between the intermediate transfer belt 21 and a recording medium S after the secondary transfer. The winding electric field is influenced by the environmental change of the secondary transfer roller 51 under the constant current control and by the resistance change due to the kind of the recording medium S. If the charge elimination or the recording medium S by the charge eliminator 54 is insufficient, the winding force between the recording medium S and the intermediate transfer belt 21 becomes stronger than the attracting force of the plate 55 thereby to cause a phenomenon that the intermediate transfer belt 21 is wrapped with the recording medium S after the secondary transfer. If the attracting force by the plate 55 is excessively strong, the recording medium S contacts the guide member 62 to cause a damage on the image. If the charge on the recording medium S is excessively eliminated, the force to attract the toner to the recording medium S is weakened to obscure the image.

For preventing the recording medium S from winding on the intermediate transfer belt 21 thereby to attain an image of high quality, it is necessary to balance the attracting force A by the plate 55 and the winding force B by the winding electric field to occur between the intermediate transfer belt 21 and the recording medium S, as shown in FIG. 4.

There are various causes for winding the recording medium on the intermediate transfer belt 21. One winding cause is the fluctuations of the secondary transfer voltage due to the environmental change at the time the secondary transfer by applying the secondary transfer bias voltage under the constant current control. Since the fluctuation ranges of the secondary transfer voltage are different for their causes, the charge elimination bias voltage (i.e., the charge elimination ability) has to be controlled finely. Moreover, frequency of the occurrence of the winding is different for the typo and thickness of the recording medium and for the order of first or second of the double-sided printing. Therefore, it is necessary to control the charge eliminating bias voltage considering not only the fluctuations of the secondary transfer voltage but also another winding cause. Otherwise, problems of the loss of power consumption and the shortened lifetime of the charge eliminator 54 are caused.

Another cause for the winding of the recording medium on the intermediate transfer belt 21 is the change in the durability of the charge eliminator 54. This is because the paper powder sticks to the charge eliminator 54 thereby to lower the charge eliminating ability as the operation time period increases.

SUMMARY

It is therefore one advantageous aspect of this invention to provide an image forming apparatus, which can perform an efficient charge elimination in accordance with the winding causes of a recording medium after a secondary transfer is performed, and which can prevent the recording medium from winding on an intermediate transfer member.

According to one aspect of the invention, there is provided an image forming apparatus, operable to form an image on a recording medium, the apparatus comprising:

an image carrier, adapted such that a tone image is formed thereon by developing an electrostatic latent image;

an intermediate transfer member, adapted such that the toner image is primarily transferred thereto; and a transfer device, comprising:

a roller member, adapted to come in contact with the intermediate transfer member; and a first bias voltage applier, operable to provide a transfer voltage, thereby applying a first bias voltage between the roller member and the intermediate transfer member to secondarily transfer the toner image onto the recording medium in order to obtain the image;

a charge eliminator, disposed in the vicinity of the roller member;

a second bias voltage applier, operable to apply a second bias voltage to the charge eliminator to eliminate charges on the recording medium which has been subjected to the application of the first bias voltage; and a controller, operable to vary the second bias voltage in accordance a deviation amount of the first bias voltage.

The controller may be provided with, in advance, a table in which a plurality of value ranges are provided for the transfer voltage, and a value of the second bias voltage is associated with one of the value ranges.

The controller may be operable to vary the second bias voltage in accordance with the number of recording media which have been passed through the charge eliminator.

According to one aspect of the invention, there is provided an image forming apparatus, operable to form an image on a recording medium, the apparatus comprising:

an image carrier, adapted such that a toner image is formed thereon by developing an electrostatic latent image;

an intermediate transfer member, adapted such that the toner image is primarily transferred thereto; and a transfer device, comprising.

a roller member, adapted to come in contact with the intermediate transfer member; and a first bias voltage applier, operable to apply a first bias voltage between the roller member and the intermediate transfer member to secondarily transfer the toner image onto the recording medium, thereby obtaining the image;

a charge eliminator, disposed in the vicinity of the roller member;

a second bias voltage applier, operable to apply a second bias voltage to the charge eliminator to eliminate charges on the recording medium which has been subjected to the application of the first bias voltage; and a controller, operable to increase the second bias voltage for a prescribed time period when the apparatus is activated or recovered form a standby state thereof.

The controller may be operable to vary the second bias voltage in accordance with the number at recording media which have been passed through the charge eliminator.

The controller may be operable to acquire calendar information, and to vary the second bias voltage with reference to the calendar information.

The image calendar information may be indicative of a season in which an environmental temperature of the apparatus becomes lower than a prescribed value.

The image forming apparatus may further comprise a timer, operable to count a time period elapsed from when the apparatus is deactivated or placed in the standby state. The controller may be operable to vary the second bias voltage with reference to the time period.

The controller may be operable to vary the second bias voltage with reference to humidity information indicative of an environmental humidity of the apparatus.

The image forming apparatus may further comprise a humidity sensor, operable to variably provide the humidity information.

The controller may be operable to acquire the humidity information from an external device by way of a network.

According to one aspect of the invention, there is provided an image forming apparatus, operable to form an image on a recording medium, the apparatus comprising:

an image carrier, adapted such that a toner image is formed thereon by developing an electrostatic latent image;

an intermediate transfer member, adapted such that the toner image is primarily transferred thereto; and a transfer device, comprising:

a roller member, adapted to come in contact with the intermediate transfer member; and a first bias voltage applier, operable to apply a first bias voltage between the roller member and the intermediate transfer member to secondarily transfer the toner image onto the recording medium, thereby obtaining the image;

a charge eliminator, disposed in the vicinity of the roller member;

a second bias voltage applier, operable to apply a second bias voltage to the charge eliminator to eliminate charges on the recording medium which has been subjected to the application of the first bias voltage; and a controller, operable to vary the second bias voltage with reference to pressure information indicative of an environmental atmospheric pressure of the apparatus.

The controller may be operable to acquire calendar information, and to vary the second bias voltage with reference to the calendar information.

The controller may be provided with, in advance, the pressure information in accordance with an altitude of a location at which the apparatus is installed.

The image forming apparatus may further comprise a pressure sensor, operable to variably provide the pressure information.

The controller may be operable to acquire the pressure information from an external device by way of a network.

DETAILED DESCRIPTION OF THE EXEMPLARY EMBODIMENTS

Exemplary embodiments of the invention will be described below with reference to the accompanying drawings.

Figure 1:
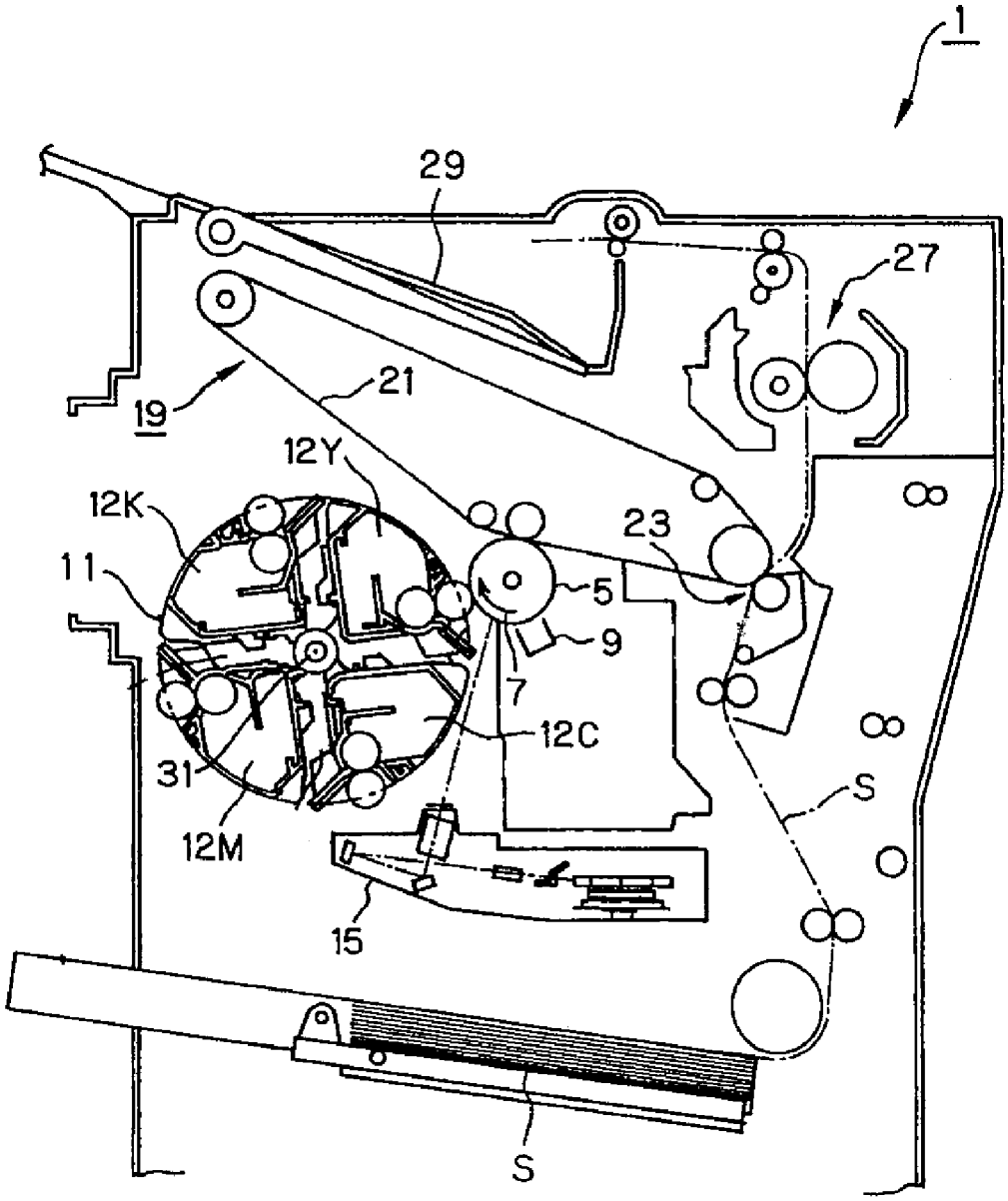
FIG. 1 is a schematic section view of an image forming apparatus.
Figure 2:
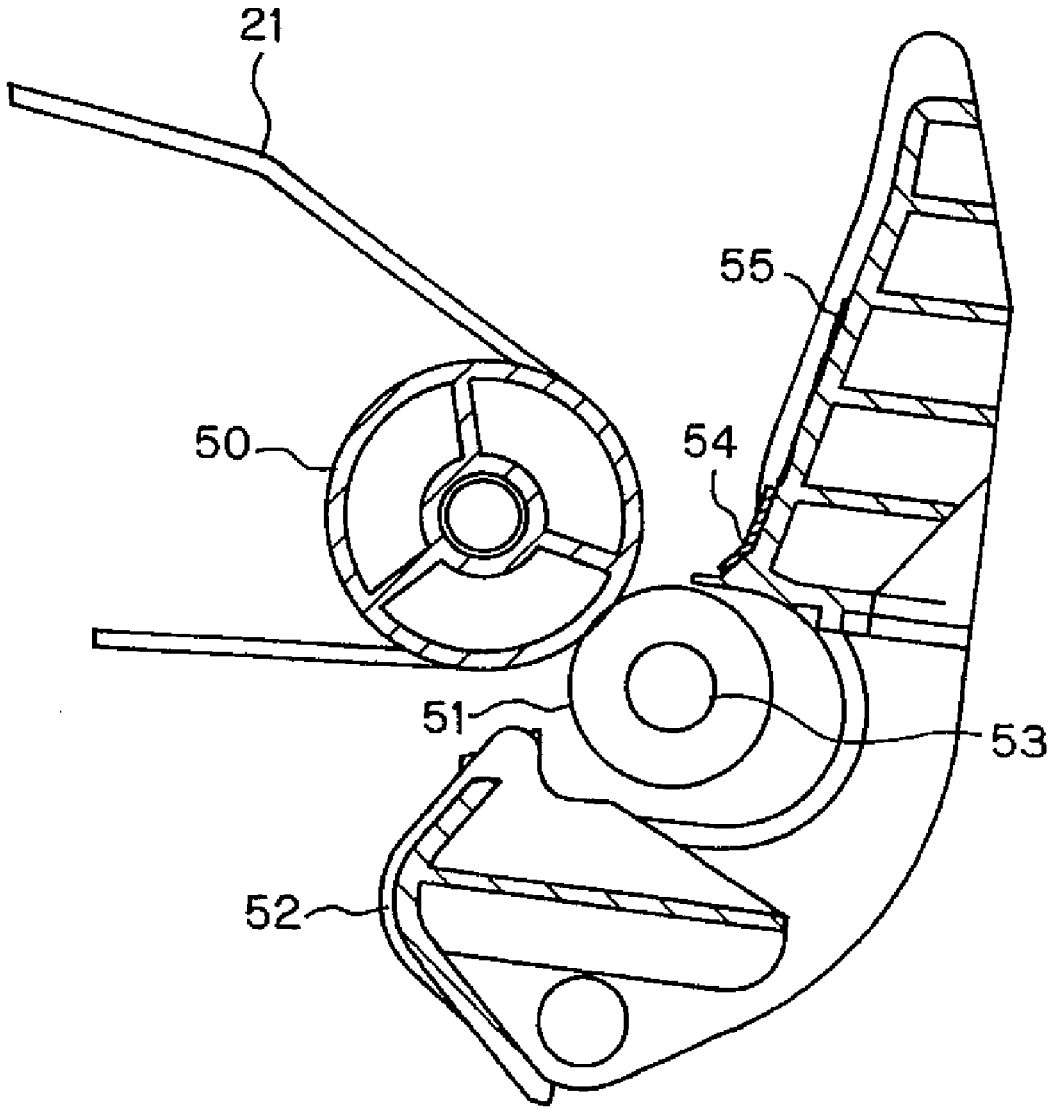
FIG. 2 is a section view of a secondary transfer device in the image forming apparatus.
Figure 3:
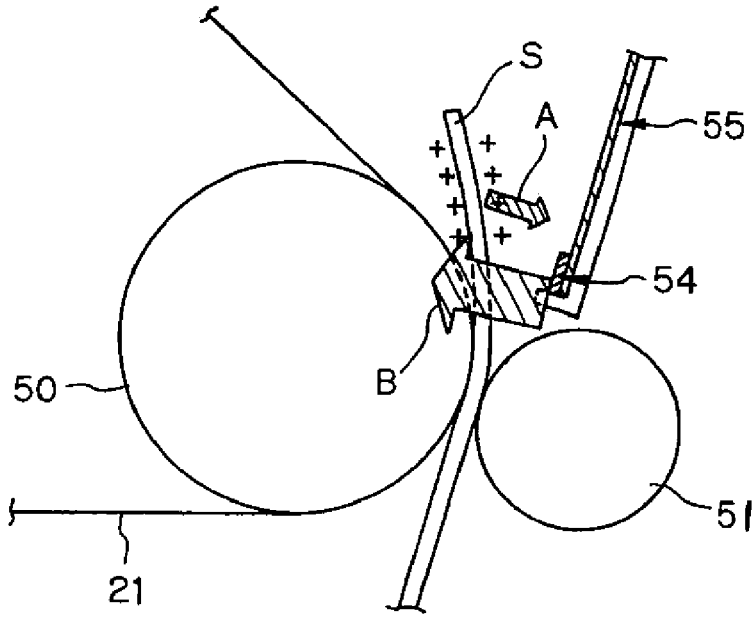
FIGS. 3 and 4 are diagrams for explaining forces acting on a recording medium in the secondary transfer device.
Figure 4:
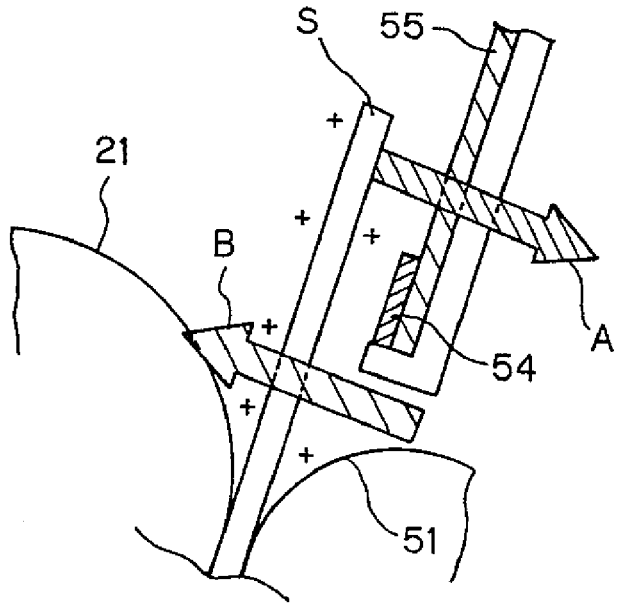

As shown in FIG. 1, an image forming apparatus 1 according to a first embodiment is equipped with a photosensitive drum 5 serving as an image carrier and configured to be rotate in a direction shown by an arrow 7. The image forming apparatus 1 is further equipped with a charging device 9, a rotary developing device 11, an exposure device 15, a primary transfer device 19, an intermediate transfer bolt 21, a secondary transfer device 23, a fusing device 27 and a sheet ejecting tray 29.

The photosensitive drum 5 has a cylindrical conductive substrate and a photosensitive layer formed on the outer circumference of the substrate.

The recharging device 9 is a device for charging the photosensitive drum 5, and the exposure device 15 is a device for forming a latent image on the charged photosensitive drum 5 by irradiating the photosensitive drum 5 with a laser beam. This exposure device 15 includes a semiconductor laser, a polygon mirror and an F-θ lens, and irradiates the charged photosensitive drum 5 with the modulated laser beam on the basis of image signals inputted from the not-shown host computer such as a personal computer or a word processor.

The rotary developing device 11 is a device for developing the latent image formed on the photosensitive drum 5, with black (K) toner contained in a block developing device 12K, magenta (M) toner contained in a magenta developing device 12M, cyan (C) toner contained in a cyan developing device 12C, and yellow toner (Y) contained in a yellow developing device 12Y.

In this embodiment, the rotary developing device 11 is enabled by rotations to move the positions of the four developing devices 12K, 12M, 12C and 12Y. In other words, the rotary developing device 11 can turn the four developing devices 12K, 12M, 12C and 12Y on a spindle 31 while keeping their relative positions.

Each time the image formation of one page ends, the rotary developing device 11 confronts the photosensitive drum 5 so that the latent images formed on the photosensitive drum 5 are sequentially developed with the toners T contained in the individual developing devices 12K, 12M, 12C and 12Y. Here, these four developing devices 12K, 12M, 12C and 12Y can be removably mounted in the aforementioned holding portions of the rotary developing device 11.

The primary transfer device 19 is a device for transferring a monochrome toner image formed on the photosensitive drum 5, to the intermediate transfer belt 21. When the four color toners are transferred, a full-color toner image is formed on the intermediate transfer belt 21. This intermediate transfer belt 21 is an endless belt circulated at a speed which is substantially the same as a circumferential speed of the photosensitive drum 5. Here, the intermediate transfer belt 21 may be replaced with an intermediate transfer drum. The secondary transfer device 23 is a device for transferring the monochrome toner image or the full color toner image formed on the intermediate transfer belt 21, to a recording medium such as paper, film or cloth.

The fusing device 27 is a device for fusing the monochrome tone image or the full color toner image transferred to the recording medium, to the recording medium, thereby to form a permanent image.

The details of the secondary transfer device 23 are the same as those as explained in the background section of the present specification, and repetitive explanations for those will be omitted.

In this embodiment, a secondary transfer voltage Vt2 is divided into a plurality of ranges based on threshold values VA and VB, and a table having charge elimination bias voltage values Vj set for the ranges as shown in Table 1 is stored in a not-shown controller in advance.

TABLE 1

| Vt2 | less than VA | VA to VB | more than VB |
|---|---|---|---|
| Vj | X | Y | Z |

Figure 5:
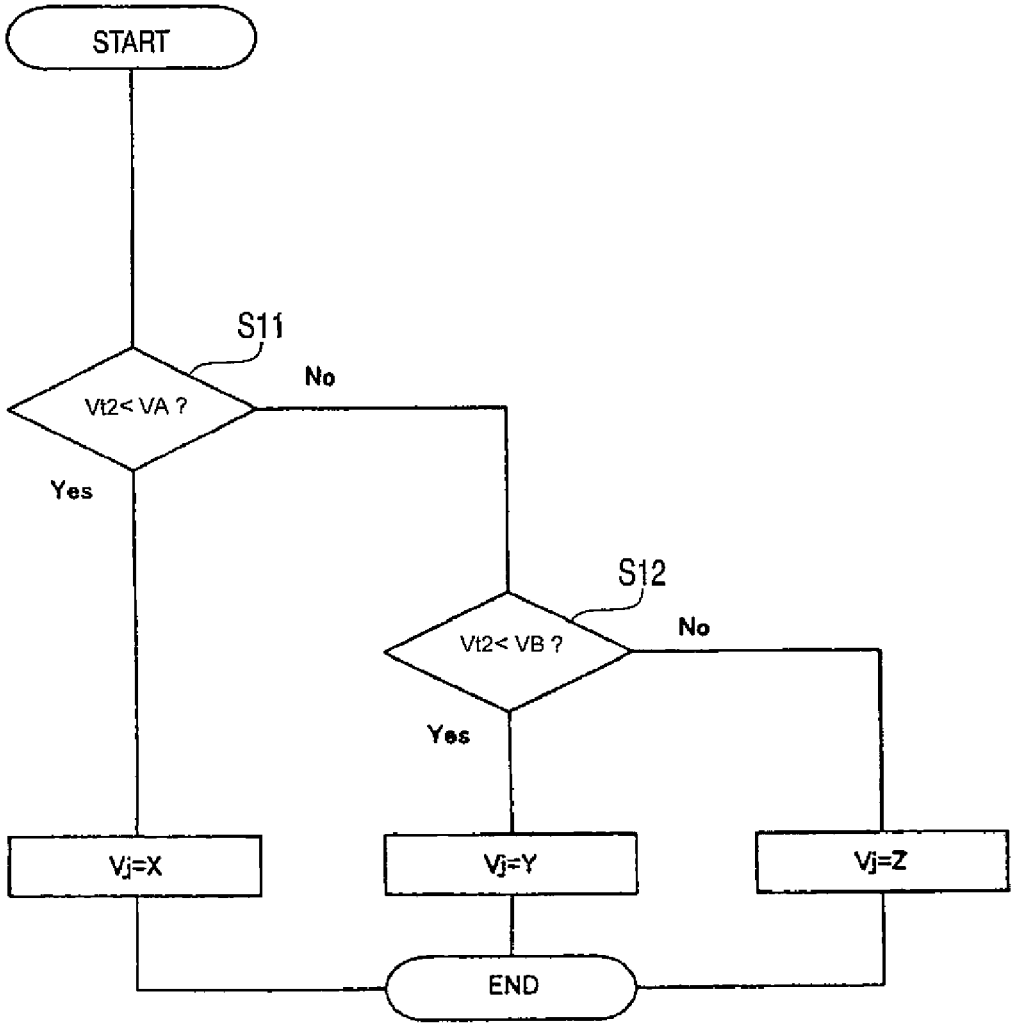
FIG. 5 is a flowchart showing how to determine a charge eliminating bias voltage in the secondary transfer device, according to a first embodiment of the invention.

FIG. 5 shows how to determine the charge eliminating bias voltage Vj applied to the secondary transfer device 23. First, it is decided whether or not the secondary transfer voltage Vt2 is less than the threshold value VA (step S11). For example, the threshold value VA of the secondary transfer voltage Vt2 is 1,500 V. In a case where the decision of the step S11 is Yes, it is decided from the table that the charge elimination bias voltage value Vj is X. For example, the decision value X is −500 V. In a case where the decision of the step S11 is No, it is decided whether or not the secondary transfer voltage Vt2 is less than the threshold value VB (step S12). For example, the threshold value VB of the second transfer voltage Vt2 is 2,500 V. In a case where the decision of the step S12 is Yes, it is decided from the table that the charge elimination bias voltage value Vj is Y. For example, the decision value Y is −1,500 V. In a case where the decision of the step S12 is No, it is decided from the table that the charge elimination bias voltage value Vj is Z. For example, the decision value Z is −2,500 V.

By thus storing the table in advance with the charge elimination bias voltage values for every fluctuation widths of the second transfer voltage Vt2, the control of the charge elimination bias voltage can be facilitated to prevent the recording medium from winding on the intermediate transfer belt 21, as might otherwise be caused by the fluctuations of the secondary transfer voltage at the secondary transfer device under the constant current control.

The frequency of the winding of the recording medium on the intermediate transfer belt 21 is made different by the difference of the kind of the recording medium, the difference of the thickness of the recording medium and the difference of the order of first or second of the double-side printing on the recording medium. Since these causes can be predicted based on their occurring principle, the secondary transfer voltages for every occurring causes and the according charge elimination bias voltages are set and stored in the table, and the occurring causes are selected at the print starting time thereby to decide the charge elimination bias voltage values. Then, the controls can be facilitated to prevent the recording medium from winding on the intermediate transfer belt 21, as might otherwise be caused by the fluctuations of the secondary transfer voltage at the secondary transfer device under the constant current control.

Figure 6:
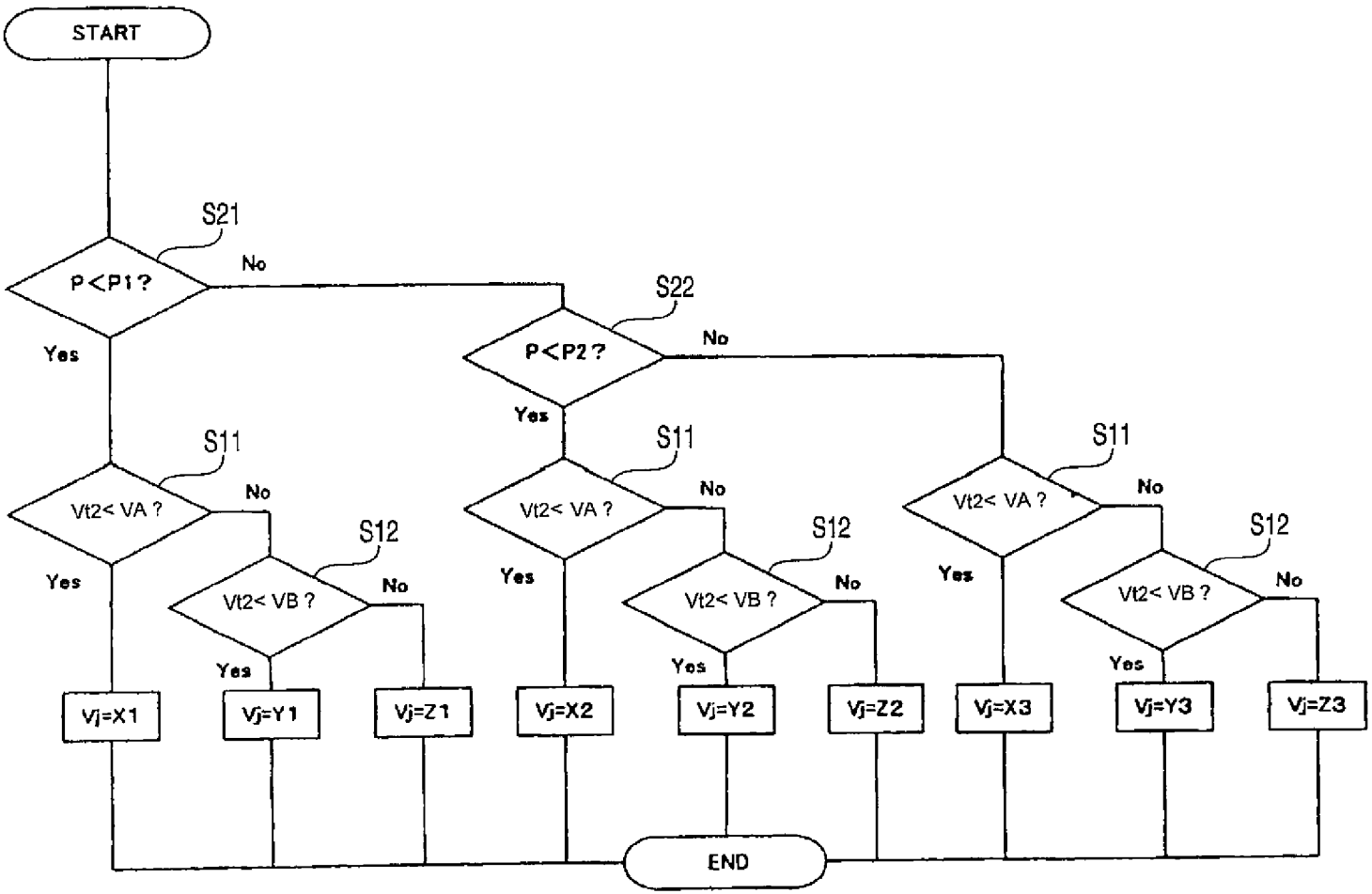
FIG. 6 is a flowchart showing how to determine a charge eliminating bias voltage in the secondary transfer device, according to a second embodiment of the invention.

Next, a second embodiment of the invention will be described with reference to FIG. 6. Similar processings to those in the first embodiment will be designated by the same reference numerals, and repetitive explanations for those will be omitted.

In this embodiment, the durability of the charge eliminator 54 is taken into account in addition to the judgments performed in the first embodiment. The durability of the charge eliminator 54 is defined by the number of recording media having passed through the charges eliminator 54. The number of media P is divided into ranges P1, P2 and P3, and a table shown in Table 2 is stored in a not-shown controller in advance.

TABLE 2

| | Vt2 | | |
|---|---|---|---|
| | less than VA | VA to VB | more than VB |
| less than P1 | X1 | Y1 | Z1 |
| P1 or more but less than P2 | X2 | Y2 | Z2 |
| P2 or more | X3 | Y3 | Z3 |

First, is decided whether or not the number of media P is less than P1 (step S21). For example, the number of media P1 is 30,000. In a case where the decision of the step S21 is Yes, the charge eliminating bias voltage X1, Y1 or Z1 is determined on the basis of the threshold values VA and VB of the secondary transfer voltage Vt2 as in the first embodiment. For example, the charge elimination bias voltage values X1, Y1 and Z1 are −500 V, −1,500 V and −2,500 V, respectively.

In a case where the decision of the step S21 is No, it is decided whether or not the number of media P is less than P2 (step S22). For example, the number of media P2 is 60,000. In a case where the decision of the step S22 is Yes, the charge eliminating bias voltage X2, Y2 or Z2 is determined on the basis of the threshold values VA and VB of the secondary transfer voltage Vt2 as in the first embodiment. For example, the charge elimination bias voltage values X2, Y2 and Z2 are −1,000 V, −2,000 V and −2,500 V, respectively.

In a case where the decision of the step S22 is No, the charge eliminating bias voltage X3, Y3 or Z3 is determined on the basis of the threshold values VA and VB of the secondary transfer voltage Vt2 as in the first embodiment. For example, the charge elimination bias voltage values X3, Y3 and Z3 are −1,500 V, −2,500 V and −2,500 V, respectively.

It is found that the winding of the recording medium on the intermediate transfer belt 21 frequently occurs when the apparatus is activated or when the apparatus is recovered from the standby state. This is because the apparatus is not sufficiently warmed up in such conditions and the resistance of the secondary transfer device 23 or the resistance of the recording medium S increases because of the low temperature. On the other hand, the charge elimination ability of the charge eliminator 54 decreases as the number of printing operation increases, so that the charge elimination of the recording medium S after the secondary transfer becomes insufficient, thereby causing the winding easily. Due to the fluctuations in the humidity, moreover, the recording medium S is inversely curled to cause the winding when the humidity is high.

Figure 7:
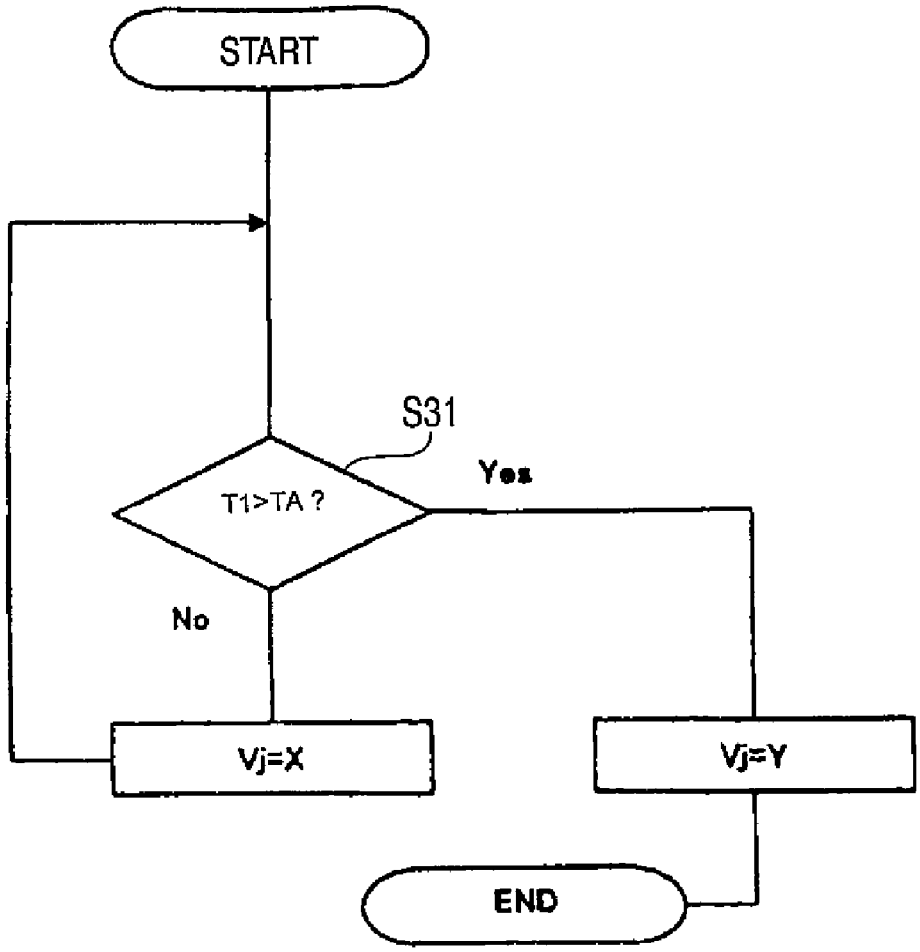
FIG. 7 is a flowchart showing how to determine a charge eliminating bias voltage in the secondary transfer device, according to a third embodiment of the invention.

In view of the above, a third embodiment of the invention will be described with reference to FIG. 7. In this embodiment, the charge elimination bias voltage value is set high for a prescribed time period TA when the apparatus is activated or recovered from the standby state. For example, the prescribed time period TA is 5 min. A table as shown in Table 3 is stored in a not-shown controller in advance.

TABLE 3

| T1 | TA or less | more than TA |
|---|---|---|
| Vj | X | Y |

First, it is decided whether or not the lapse time T1 from when the apparatus is activated or recovered from the standby state of the apparatus is larger than the prescribed time period TA (step S31). In a case where the decision of the step S31 is No, a charge elimination bias voltage Vj is set at X higher than a default value. The set value X of the charge elimination bias voltage Vj is −2,000 V, for example. In a case where the decision of the step S31 is Yes, that is, in case a prescribed time period elapsed and the apparatus has been warmed up, the charge elimination bias voltage Vj is set to a prescribed value Y. The value Y of the charge elimination bias voltage Vj is −1,000 V, for example.

Figure 8:
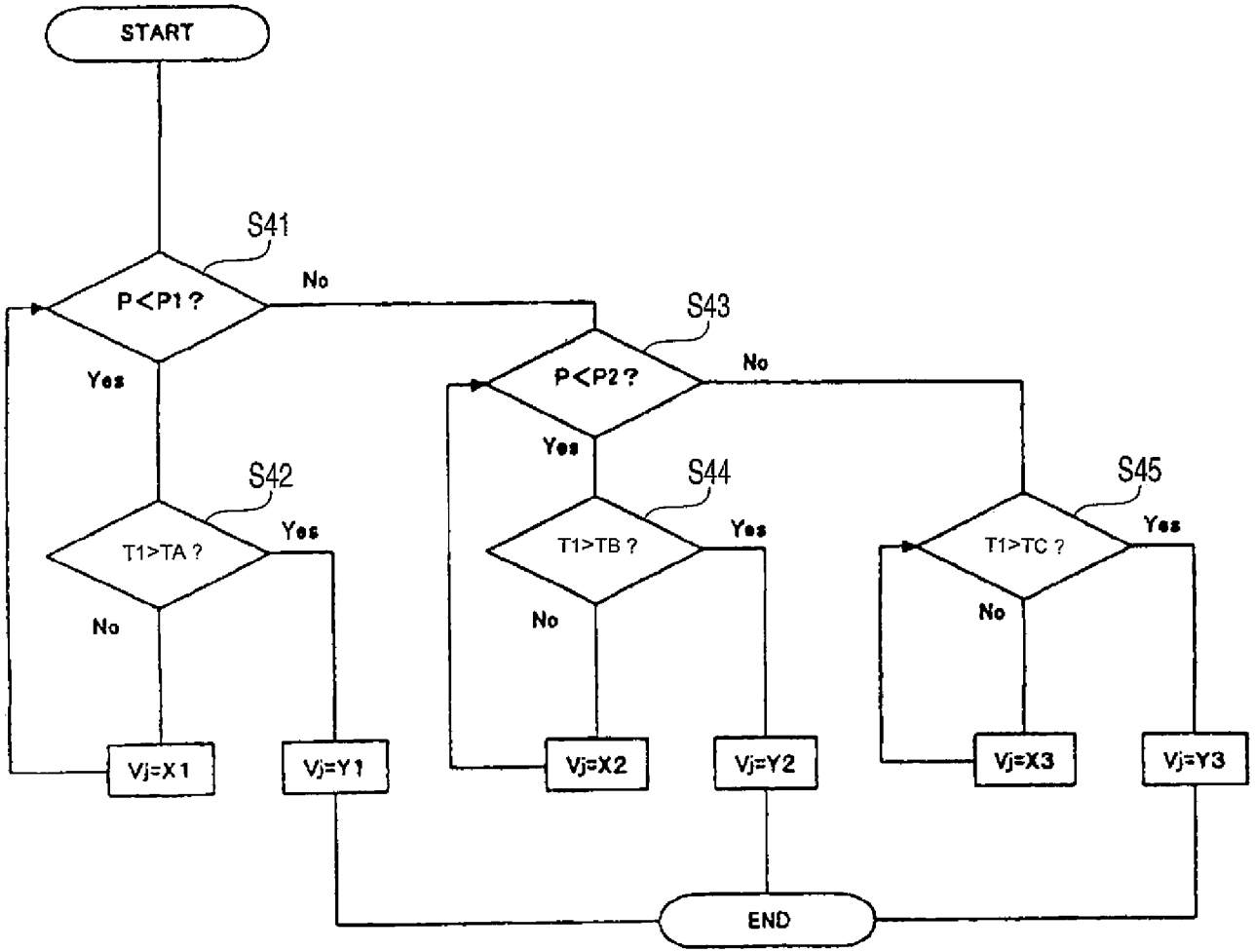
FIG. 8 is a flowchart showing how to determine a charge eliminating bias voltage in the secondary transfer device, according to a fourth embodiment of the invention.

Next, a fourth embodiment of the invention will be described with reference to FIG. 8.

In this embodiment, the durability of the charge eliminator 54 is taken into account in addition to the judgments performed in the first embodiment. The durability of the charge eliminator 54 is defined by the number of recording media having passed through the charge eliminator 54. The number of media P is divided into ranges, P1, P2 and P3, and a table shown in Table 4 is stored in a not-shown controller in advance.

TABLE 4

| | T1 | |
|---|---|---|
| | TA or less | more than TA |
| less than P1 | X1 | Y1 |
| P1 or more but less than P2 | X2 | Y2 |
| P2 or more | X3 | Y3 |

First, it is decided whether or not the number of media P is less than the threshold value P1 (step S41). This threshold value P1 is 30,000, for example. In a case where the decision of the step S41 is Yes, it is decided whether or not the lapse time T1 from when the apparatus is activated or recovered from the standby state is larger than the prescribed time period TA (step S42). The prescribed time period is set to 10 min, for example. In a case where the decision of the step S42 is No, the charge elimination bias voltage Vj is set at X1 higher than a default value, and the flow is returned to step S41. The charge elimination bias voltage value X1 is −2,500 V, for example. In a case where the decision of the step S42 is Yes, the charge elimination bias voltage value is set at Y1. The charge elimination bias voltage value Y1 is set to −1,000 V, for example.

In a case where the decision of the step S41 is No, it is decided whether or not the number of media P is less than P2 (step S43). The threshold value P2 is set to 60,000, for example. In a case where the decision of the step S43 is Yes, it is decided whether or not the lapse time T1 from when the apparatus is activated or recovered from the standby state is larger than the prescribed time period TB (step S44). The prescribed time period TB is set to 15 min, for example. In a case where the decision of the step S44 is No, the charge elimination bias voltage Vj is set to X2 higher than the default value, and the flow is returned to the step S43. The charge elimination bias voltage value X2 is set at −2,500 V, for example. In a case where the decision of the step S44 is Yes, the charge elimination bias voltage value is set to Y1. The charge elimination bias voltage value Y1 is set to −1,000 V, for example.

In a case where the decision of the step S43 is No, it is decided whether or not the lapse time T1 from when the apparatus is activated or recovered from the standby state is larger than prescribed time period TC (step S45). The prescribed time period TC is set to 20 min, for example. In a case where the decision of the step S45 is No, the charge elimination bias voltage value Vj is set to X3, and the flow is returned to the step S45. The charge elimination bias voltage value X3 is set at −2,500 V, for example. In a case where the decision of the step S45 is Yes, the charge elimination bias voltage value Vj is set to Y3. For example, the charge elimination bias voltage value Y3 is set to −2,000 V.

Figure 9:
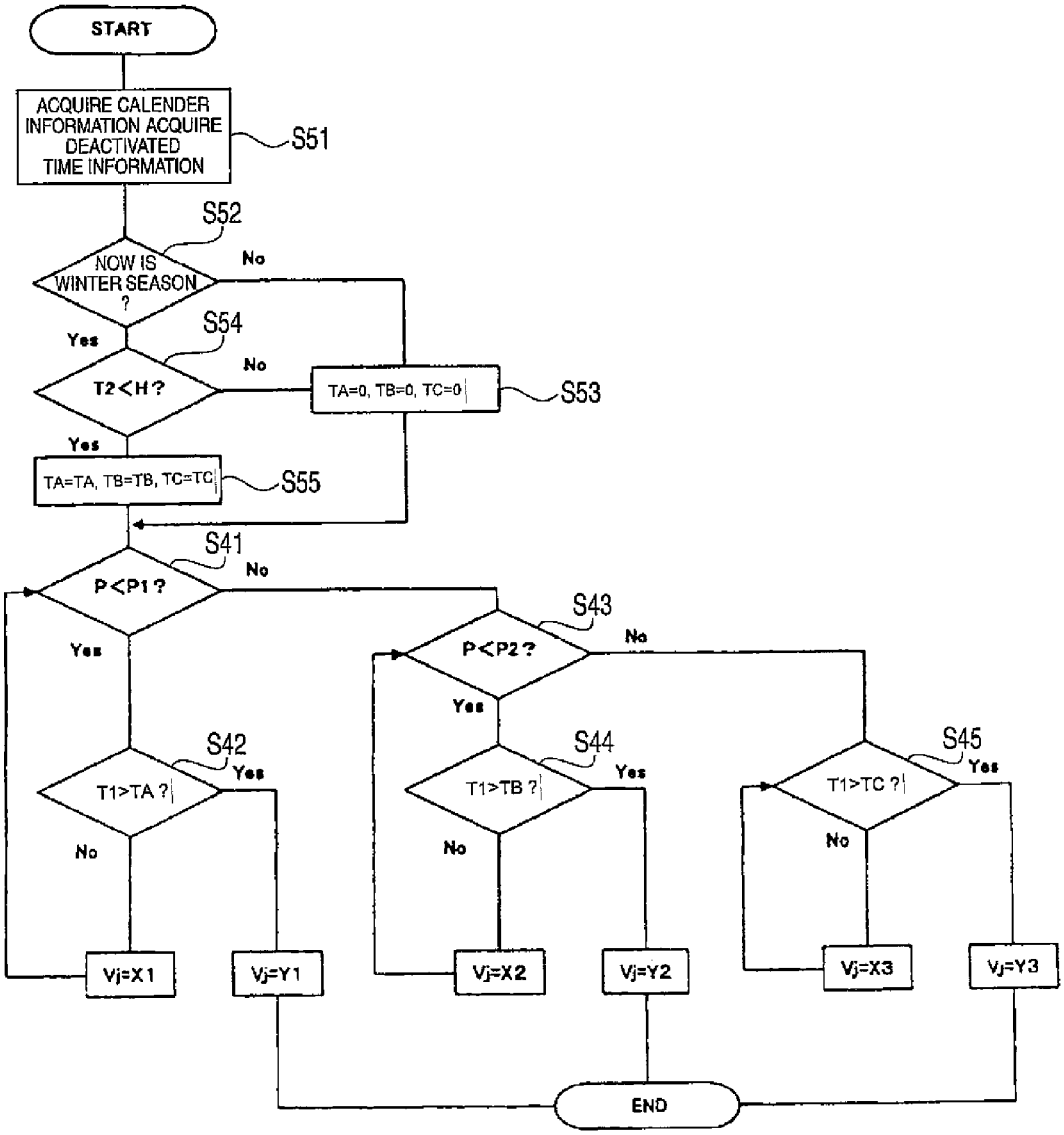
FIG. 9 is a flowchart showing how to determine a charge eliminating bias voltage in the secondary transfer device, according to a fifth embodiment of the invention.

Next, a fifth embodiment of the invention will be described with reference to FIG. 9. Similar processings to those in the fourth embodiment will be designated by the same reference numerals, and repetitive explanations for those will be omitted.

In this embodiment, it is judged whether now is the low-temperature season based on calendar information, and the lapse time from when the apparatus is deactivated or placed in the standby state is taken into account, in addition to the judgments performed in the fourth embodiment.

First, calendar information and information indicative of when the apparatus is deactivated or placed in the standby state is acquired (step S51). Next, it is decided whether or not now is the winter season based on the acquired calendar information (step S52). In a case where the decision of the step S52 is No, the threshold values TA, TB, TC are set to zero (step S53). In a case where the decision of the step S52 is Yes, it is decided whether or not the lapse time T2 from when the apparatus is deactivated or placed in the standby state is less than a prescribed time period H (step S54). For example, the prescribed time period H is set to 8 hours. In a case where the decision of the step S54 is No, the threshold values TA, TB, TC are set to zero (step S53). In a case where the decision of the step S54 is Yes, the threshold values TA, TB, TC are made valid (step S55). The following steps are the same as the fourth embodiment.

A humidity sensor may be arranged in the apparatus, and the charge elimination bias voltage is controlled according to the measured data from the humidity sensor, so that the charge elimination bias voltage can be set high to prevent the winding when the recording medium is liable to be inversely curled. Thanks to the constitution in which the humidity fluctuations are acquired by the network, the humidity information, which highly fluctuates depending upon the weather of the date considered, can be instantly acquired to control the charge elimination bias voltage precisely without using any humidity sensor thereby to prevent the winding.

It is found that fluctuations of the atmospheric pressure exert serious influences as the causes for winding the recording medium on an intermediate transfer belt 21. This is because the discharge starting voltage at the secondary transfer device 23 changes as the atmospheric pressure fluctuates, so that the charge elimination ability of the charge eliminator 54 changes. If the atmospheric pressure is low, the discharge starting voltage drops, and the charge on the recording medium at the secondary transfer device is not much, but the charge elimination of the recording medium after the secondary transfer by the charge eliminator is sufficiently performed, thereby to reduce the winding of the recording medium on the intermediate transfer belt 21. If the atmospheric pressure is high, on the other hand, the discharge starting voltage rises, and the charge on the recording medium at the secondary transfer device is much. In a case where the charge elimination bias voltage of the charge eliminator is fixed and controlled, the charge elimination of the recording medium after the secondary transfer is insufficiently performed, so that the recording medium easily winds on the intermediate transfer belt 21. The relations between the atmospheric pressure and the easiness in the winding are enumerated in the number of winding cases for 20 sheets of fed paper in Table 5.

TABLE 5

| | | atmospheric pressure (mmHg) | | |
|---|---|---|---|---|
| | | 760 | 717 | 674 |
| charge elimination bias voltage (V) | −1,000 | 10/20 | 0/20 | 0/20 |
| | −1,500 | 2/20 | 0/20 | 0/20 |
| | −2,500 | 0/20 | 0/20 | 0/20 |

Figure 10:
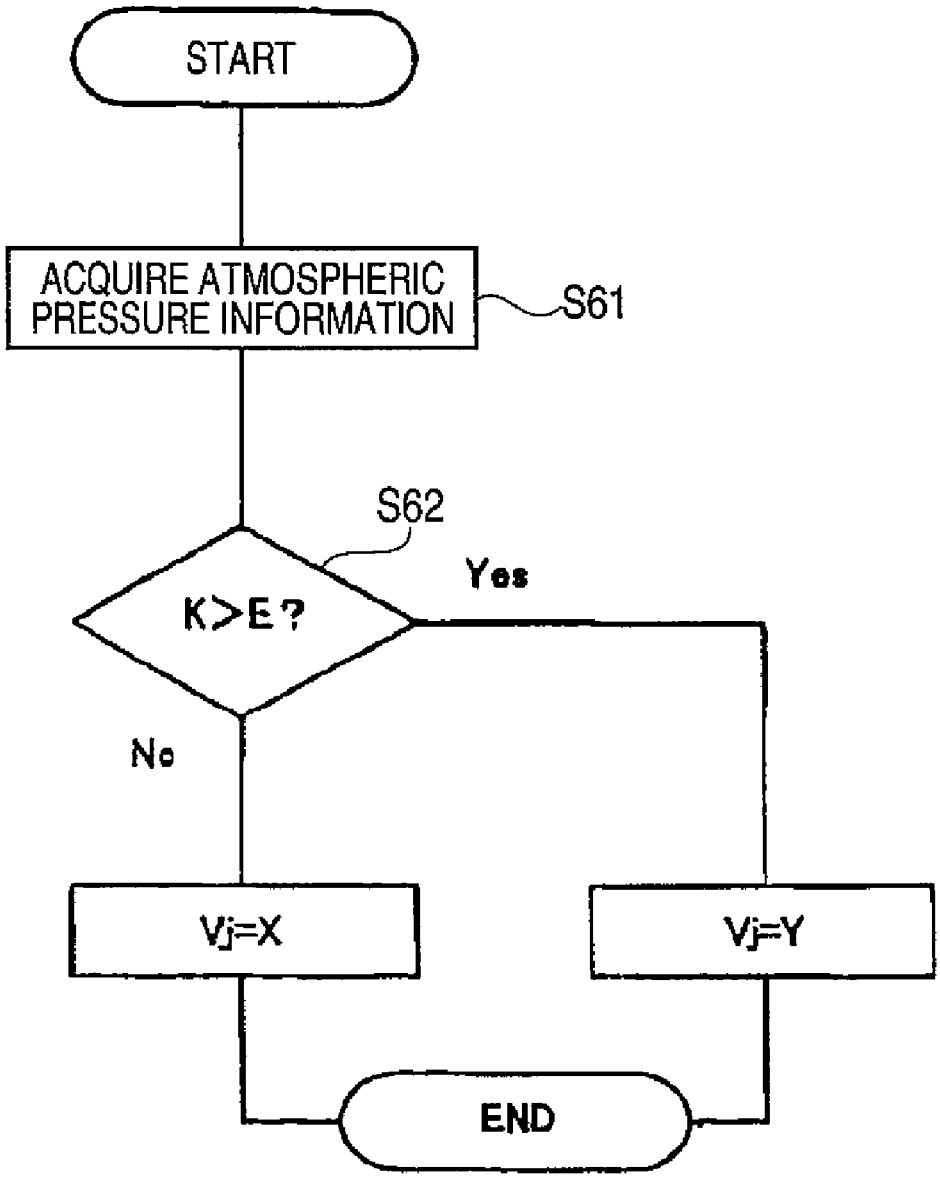
FIG. 10 is a flowchart showing how to determine a charge eliminating bias voltage in the secondary transfer device, according to a sixth embodiment of the invention.

In view of the above, a sixth embodiment of the invention will be described with reference to FIG. 10.

In this embodiment, atmospheric pressure is taken into account in order to determine a charge eliminating bias voltage value. A table as shown in Table 6 is stored in a not-shown controller in advance.

TABLE 6

| K | E or less | more than E |
|---|---|---|
| Vj | X | Y |

In this embodiment, information indicative of atmospheric pressure is first acquired (step S61) and it is decided whether or not the acquired atmospheric pressure K is higher than a threshold value E (step S62). The threshold value E of the atmospheric pressure is 717 mmHg, for example. In a case where the decision of the step S62 is No, that is, in case the atmospheric pressure is no higher than the threshold value, the winding occurrence is so low that the charge elimination bias voltage Vj is set to the relatively low value X. This charge elimination bias voltage X is 1,000 V, for example. In a case where the decision of the step S62 is Yes, that is, in case the atmospheric pressure is high, the winding occurrence is so high that the charges elimination bias voltage Vj is set to the relatively high value Y. This charge elimination bias voltage is −2,000 V, for example.

Figure 11:
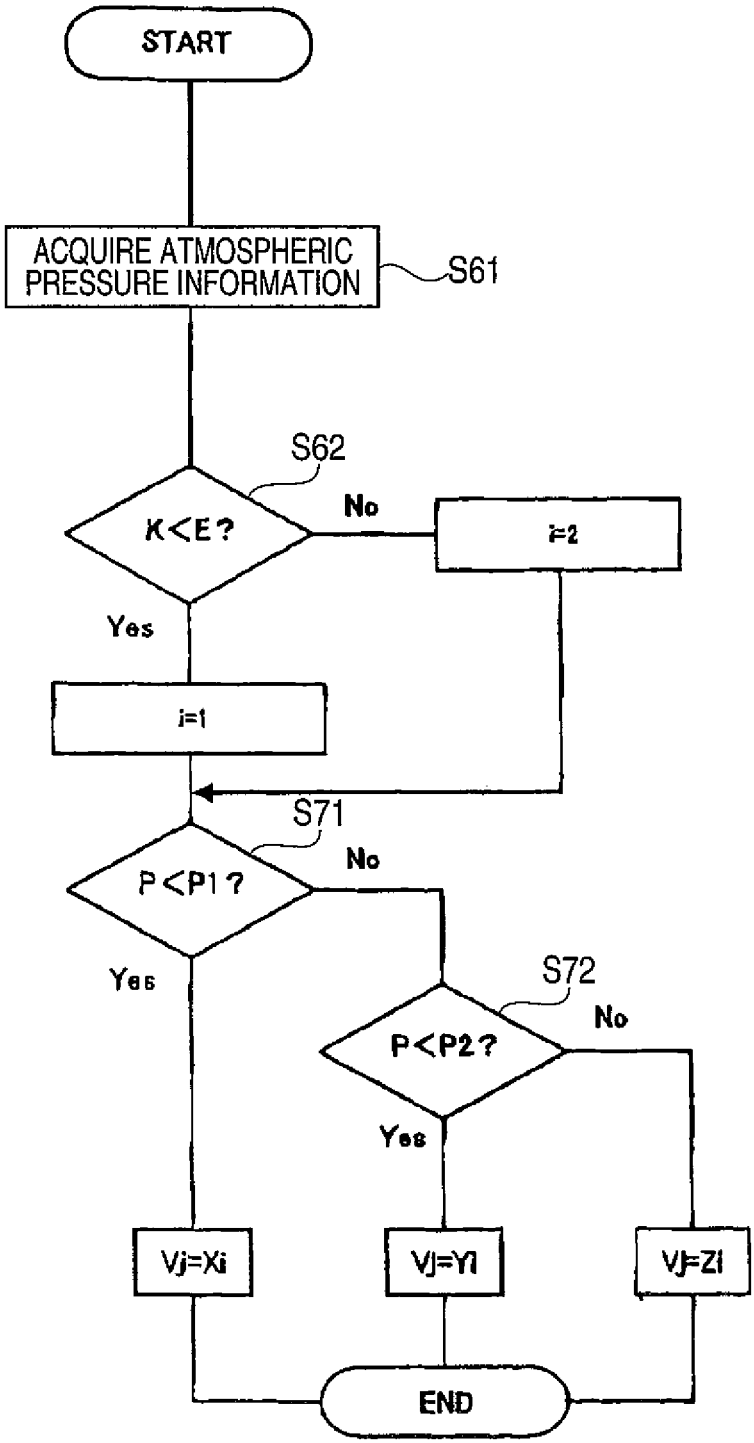
FIG. 11 is a flowchart showing how to determine a charge eliminating bias voltage in the secondary transfer device, according to a seventh embodiment of the invention.

Next, a seventh embodiment of the invention will be described with reference to FIG. 11. Similar processings to those in the sixth embodiment will be designated by the same reference numerals, and repetitive explanations for those will be omitted.

In this embodiment, the durability of the charge eliminator 54 is taken into account in addition to the judgments performed in the first embodiment. The durability of the charge eliminator 54 is defined by the number of recording media having passed through the charge eliminator 54. The number of media P is divided into ranges P1 and P2, and a table shown in Table 7 is stored in a not-shown controller in advance.

TABLE 7

| | K | |
|---|---|---|
| | E or less | more than E |
| less than P1 | X1 | X2 |
| P1 or more but less than P2 | Y1 | Y2 |
| P2 or more | Z1 | Z2 |

In a case where the decision of the step S62 is Yes, it is decided whether or not the number of media P is less than the threshold value P1 (step S71). This threshold value P1 is 30,000, for example. In a case where the decision of the step S71 is Yes, the charge elimination bias voltage is set to X1. The charge elimination bias voltage X1 is −500 V, for example. In a case where the decision of the step S71 is No, it is decided whether or not the number of media P is less than a second threshold value P2 (step S72). The second threshold value P2 of Embodiment 2 is 60,000, for example. In a case where the decision of the step S72 is Yes, the charge elimination bias voltage is set to Y1. The charge elimination bias voltage Y1 is −1,000 V, for example. In a case where the decision of the step S72 is No, the charge elimination bias voltage is set to Z1. The charge elimination bias voltage Z1 is −1,500 V, for example.

In a case where the decision of the step S62 is No, the number of media P of the charge eliminator is likewise compared with the first threshold value P1 and the second threshold value P2, and the charge elimination bias voltages are set to X2, Y2 and Z2. For example, the charge elimination bias voltage values X2, Y2 and Z2 are −1,500 V, −2,000 V and −2,500 V, respectively.

As the acquisition of the atmospheric pressure information, the charge elimination bias voltage may be set in advance at the apparatus mounting time in accordance with the altitude of the mounting place. In order to cope with the abrupt atmospheric pressure fluctuations according to the weather or the like, a barometer may be arranged in the apparatus thereby to acquire the atmospheric pressure information, or the atmospheric pressure information may be acquired by the network.

With the above configurations, the occurrence of the winding of the recording medium S on the intermediate transfer member 21 can be reduced, and the electric power to be consumed for the charge elimination bias voltage can be reduced.

The disclosure of Japanese Patent Application Nos. 2005-333845 filed Nov. 18, 2005, 2005-333846 filed Nov. 18, 2005 and 2005-333847 filed Nov. 18, 2005 including specifications, drawings and claims are incorporated herein by reference in their entirety.

What is claimed is:

1. An image forming apparatus, operable to form an image on a recording medium, the apparatus comprising:

an image carrier, adapted such that a toner image is formed thereon by developing an electrostatic latent image;

an intermediate transfer member, adapted such that the toner image is primarily transferred thereto; and a transfer device, comprising:

a roller member, adapted to come in contact with the intermediate transfer member; and a first bias voltage applier, operable to apply a first bias voltage between the roller member and the intermediate transfer member to secondarily transfer the toner image onto the recording medium, thereby obtaining the image;

a charge eliminator, disposed in the vicinity of the roller member;

a second bias voltage applier, operable to apply a second bias voltage to the charge eliminator to eliminate charges on the recording medium which has been subjected to the application of the first bias voltage; and a controller, operable to increase the second bias voltage for a prescribed time period when the apparatus is activated or recovered from a standby state thereof.

2. The image forming apparatus as set forth in claim 1, wherein:

the controller is operable to vary the second bias voltage in accordance with the number of recording media which have been passed through the charge eliminator.

3. The image forming apparatus as set forth in claim 1, wherein:

the controller is operable to acquire calendar information, and to vary the second bias voltage with reference to the calendar information.

4. The image forming apparatus as set forth in claim 3, wherein:

the calendar information is indicative of a season in which an environmental temperature of the apparatus becomes lower than a prescribed value.

5. The image forming apparatus as set forth in claim 1, further comprising:

a timer, operable to count a time period elapsed from when the apparatus is deactivated or placed in the standby state, wherein:

the controller is operable to vary the second bias voltage with reference to the time period.

6. The image forming apparatus as set forth in claim 1, wherein:

the controller is operable to vary the second bias voltage with reference to humidity information indicative of an environmental humidity of the apparatus.

7. The image forming apparatus as set forth in claim 6, further comprising:

a humidity sensor, operable to variably provide the humidity information.

8. The image forming apparatus as set forth in claim 6, wherein:

the controller is operable to acquire the humidity information from an external device by way of a network.

* * * * *